US007418803B2

(12) United States Patent
Jenkins et al.

(10) Patent No.: US 7,418,803 B2
(45) Date of Patent: Sep. 2, 2008

(54) SELF-CONTAINED MODULAR HOME

(76) Inventors: William O. Jenkins, 4038 Hwy 468 E., Jackson, MS (US) 39202; Terry L. Jenkins, 4038 Hwy 468 E., Jackson, MS (US) 39202; Heath O. Jenkins, 4038 Hwy 468 E., Jackson, MS (US) 39202

( * ) Notice: Subject to any disclaimer, the term of this patent is extended or adjusted under 35 U.S.C. 154(b) by 326 days.

(21) Appl. No.: 11/099,367

(22) Filed: Apr. 5, 2005

(65) Prior Publication Data

US 2005/0252099 A1 Nov. 17, 2005

Related U.S. Application Data

(60) Provisional application No. 60/559,579, filed on Apr. 5, 2004.

(51) Int. Cl.
*E04B 1/348* (2006.01)

(52) U.S. Cl. ..... 52/79.7; 52/79.1; 52/79.5; 52/79.9; 52/143

(58) Field of Classification Search ..... 52/143, 52/79.1, 79.5, 79.7, 79.8, 79.9, 293.3, 295
See application file for complete search history.

(56) References Cited

U.S. PATENT DOCUMENTS 2,287,229 A * 6/1942 Carpenter ..... 52/79.9
2,706,313 A * 4/1955 Radman ..... 52/79.9
2,990,588 A * 7/1961 McKinley ..... 52/143
3,233,935 A * 2/1966 Brindle ..... 296/168
3,765,714 A * 10/1973 Lau ..... 296/156
3,791,087 A * 2/1974 Sigal ..... 52/293.3
4,015,375 A * 4/1977 Lindsay ..... 52/143
4,144,328 A * 3/1979 Vainshtein et al. ..... 514/31
4,207,714 A * 6/1980 Mehls ..... 52/79.9

(Continued)

FOREIGN PATENT DOCUMENTS

JP 6-73822 * 3/1994

(Continued)

*Primary Examiner*—Robert Canfield
(74) *Attorney, Agent, or Firm*—Peter A. Borsari

(57) ABSTRACT

A self-contained modular home a first section, a second section and a top section, each section having an interior which is 100% complete and an exterior which requires only siding or other exterior finish for completion. The three sections of the self-contained modular home are designed to be transported on a low boy trailer or other transport system to a permanent foundation site. The modular home incorporates a unique steel cable lifting system within the floor system which enables the modules to be set on the foundation with or without the use of a crane. The modular home is bolted to a permanent slab foundation by a steel strap securing arrangement in such a manner that a one and half inch air space is created under the home. The manner in which the self-contained modular home is constructed and secured to the permanent foundation provides the modular home with up to 160 mph wind protection, which is far greater than the typical 80 mph to 100 mph offered by most site or stick built homes currently on the market. Once the modular home arrives at the construction site, the home can be set and bolted to the concrete slab, made weather tight, connected to the local plumbing and electrical services and an be operational in about three hours.

20 Claims, 7 Drawing Sheets

U.S. PATENT DOCUMENTS 4,501,098 A * 2/1985 Gregory ..... 52/79.1
4,521,120 A * 6/1985 Blank et al. ..... 374/102
5,058,343 A * 10/1991 Nipko ..... 52/233
5,353,558 A * 10/1994 Shea et al. ..... 52/143
5,640,814 A * 6/1997 Godfrey ..... 52/143
5,794,394 A * 8/1998 Bill et al. ..... 52/295
6,035,590 A * 3/2000 Lindsay ..... 52/143
2003/0056446 A1* 3/2003 Napier ..... 52/66

FOREIGN PATENT DOCUMENTS

WO WO 83/00714 * 3/1983

* cited by examiner

SELF-CONTAINED MODULAR HOME

RELATED APPLICATION

This application claims the benefit of priority of U.S. patent provisional application Ser. No. 60/559,579, filed in the United States Patent & Trademark Office on Apr. 5, 2004.

FIELD OF INVENTION

The present invention relates to a self-contained modular home which can be removed from the foundation system. More particularly, the present invention relates to a self-contained modular home comprising a first section, a second section and a top section, each section having an interior which is 100% complete and an exterior which requires only siding or other exterior finish for completion. The three sections of self-contained modular home are designed to be transported on a low boy trailer or other transport system to a permanent foundation site.

BACKGROUND OF THE INVENTION

The construction and assembly of modular homes is well known in the prior art. Typically, the standard modular home arrives at the building site in component modules that are about 80% to 90% complete, thereby requiring the builder to finish the modular home at the building site. Each component module of the standard modular home usually is set on the foundation with a crane, using straps and/or cables which cradle the outer side and under side of the home. The typical modular home then is attached to a conventional foundation such that a crawl space or air space of at least eighteen inches (18") is created under the home in order to meet current building codes. Following the setting and securing of the component modules to the foundation, a roof system is attached to the modules. Most modular homes utilize a tilt up roof system that is cumbersome and very time consuming in setting up. In contrast, the present invention provides a modular home that is 100% finished prior to leaving the factory, incorporates a unique steel cable lifting system within the floor system which enables the modules to be set on the foundation with or without the use of a crane, uses a concrete slab foundation to which the modular home is bolted, thereby decreasing the crawl/air space to 1½" and employs a one half truss system with a separate roof cap.

SUMMARY OF THE INVENTION

Accordingly, it is an object of the present invention to provide a self-contained modular home that can be quickly and easily installed on a permanent slab foundation and that can be removed from the foundation system at a later date.

It is another object of the present invention to provide a self-contained modular home comprising a first section, a second section and a top section, each section being 100% finished except for exterior siding or other exterior finish when it leaves the factory.

It is also an object of the present invention to provide a self-contained modular home that can be bolted to a permanent foundation slab in such a manner that only an inch and one half (1½") air space is created.

It is a further object of the present invention to provide a self-contained modular home having a roof truss system comprising a half truss with a separate roof cap attachment.

It is an additional object of the present invention to provide a self-contained modular home having a plumbing system that is 100% complete when it leaves the factory.

It is still another object of the present invention to provide a self-contained modular home which can be bolted to a permanent foundation and be connected to water/sewer service and electrical service within a period of hours, rather than days.

It is yet another object of the present invention to provide a self-contained modular home which can be set onto the foundation without the use of a crane.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein.

DETAILED DESCRIPTION

Figure 1:
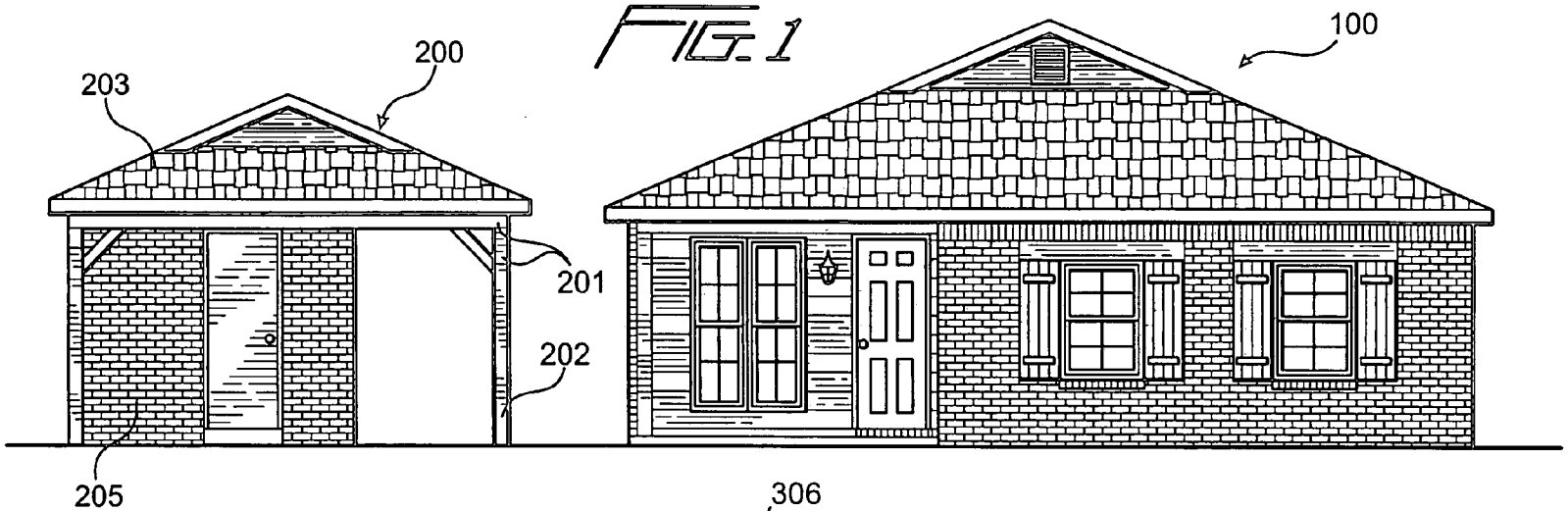
FIG. 1 is a front elevation view of the self-contained modular home of the present invention with a detached carport.
Figure 2:
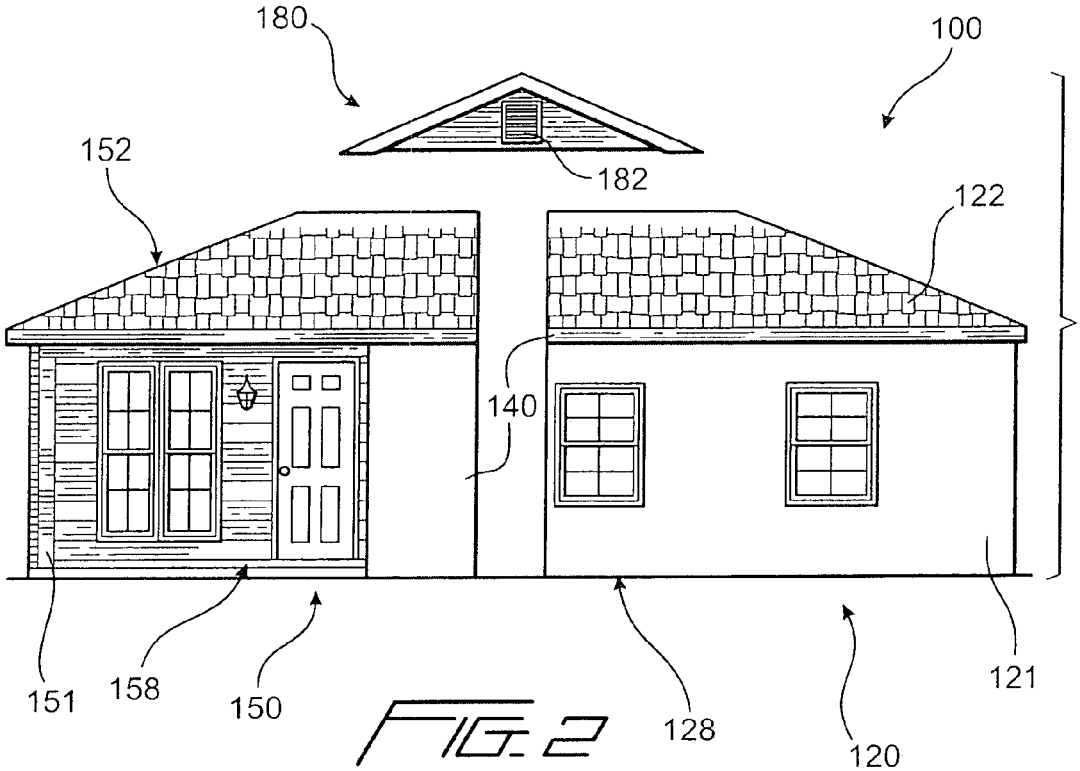
FIG. 2 is an exploded front elevation view of the self-contained modular home of the present invention illustrating the first, second and top sections.

The present invention relates to a self-contained modular home 100 as shown in FIG. 1 which can include an optional car port 200. In an alternate embodiment shown in FIGS. 11A, 11B and 11C, the self-contained modular home can include a garage 300. Referring now to FIG. 2 and the self contained modular home 100 comprises a first section 120, a second section 150, and a top section 180. More particularly, the first section 120 includes exterior walls 121 which are covered with conventional house wrap, a 5/12 pitched roof section 122 which is shingled and a first foundation system 128. Similarly, second section 150 includes exterior walls 151 which are covered with conventional house wrap, a 5/12 pitched roof section 152 which is shingled and a second foundation system 158. Each of the first and second sections has a marriage wall 140 at which point the two sections are joined together.

Figure 3:
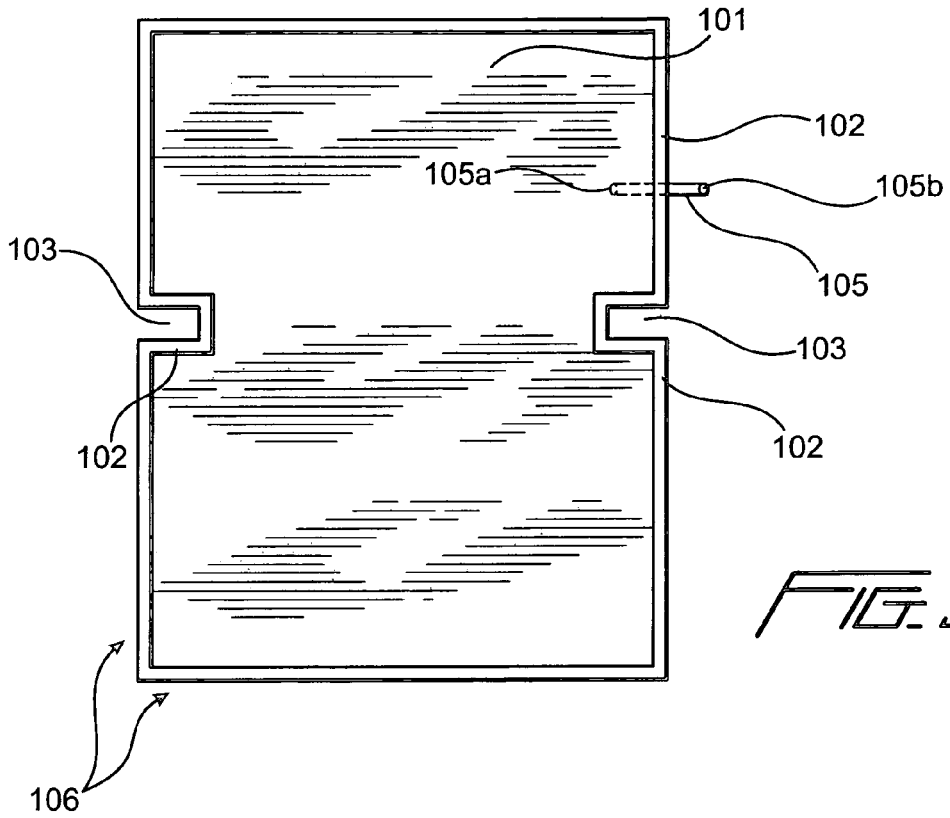
FIG. 3 is a side perspective views illustrating an exposed end of a structural bolt after the removal of the foundation forms, the exposed end extending out of the side of the permanent foundation.

The foundation is an integral part of the present invention. The foundation can be in the form of a concrete slab, curtain wall, pier or other permanent foundation onto which the self-contained modular home can be bolted. Preferably, the foundation is a concrete slab foundation. Referring now to FIG. 3, the permanent foundation 101 is formed and poured between foundation forms 102 such that a recessed area 103 is cut out on both the right side and the left side of the foundation. Preferably, each recessed area is about a two foot by about two foot (2'×2'). These two cut outs are provided to enable the plumbing to drop out of each side of the modular home and to be connected to the sewer outfall.

Figure 4:
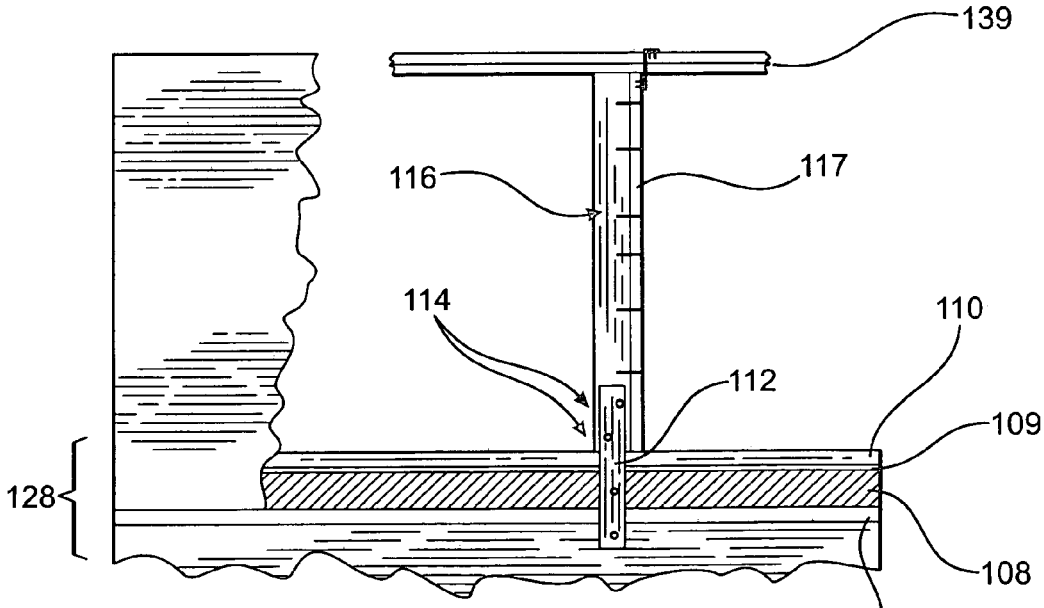
FIG. 4 is a side perspective view of the self-contained modular home of the present invention showing the attachment of the modular home to the permanent foundation.

A plurality of structural bolts 105 are placed horizontally through the foundation forms 102 to establish permanent attachment points in the permanent foundation 101 (hereinafter sometimes referred to as the "concrete slab" or "slab"). More particularly, a first end 105*a* of each of the plurality of structural bolts extends within the area encompassed by the foundation forms. Once the concrete is poured and cured, the foundation forms are removed and the first end of each of the plurality of structural bolts remains embedded in the concrete slab and the second end 105*b* of each of the plurality of structural bolts extends outside along the perimeter 106 of the permanent foundation. As shown in FIG. 4, a plurality of 2"×6" treated material, such as treated studs, are bolted four foot on center around the perimeter of the concrete foundation to establish a treated sill 107 and also up the middle of the foundation corresponding to the modular home's marriage wall. The modular home then is set on top of the treated sill.

Each of the first foundation system 128 and second foundation system 158 comprise a floor joist 108, a plywood floor 109 and a bottom plate 110. The floor joist 108 of the modular home is composed of 2"×8" treated material, such as studs having a belly board vapor barrier attached to the bottom thereof. When the modular home 100 is set on top of the treated sill 107, a one and one half inch crawl/air space 118 is created underneath the modular home foundation since the 2"×6" treated material actually are one and one half inch thick. The modular home then is bolted to the slab by a plurality of structural steel plates 112 (hereinafter sometimes referred to as "steel straps"). Each steel strap first is attached to the second end 105*b* of one of the plurality of structural bolts 105 extending out of the foundation. Lag screws 114 are used to further attach the modular home into the floor joist 108, and into a 2"×6" attachment stud 116 which is used in addition to the conventional exterior studs 117 but which are turned sideways to the exterior of the wall for stronger attachment. Lag screws 114 also are used to attach the 2"×6" sideway studs 139 to each of the conventional exterior studs 117. All of the structural bolts 105 and lag screws 114 can be removed at a later time and the home can be moved to another location if desired.

In addition to the steel strap securing arrangement, a bottom steel plate 110, preferably a 3"×6" steel plate, is nailed two foot on center to the treated sill 107 and the floor joist 108. Both these attachment arrangements provides the secured modular home with 160 mph wind protection, which is far greater than the typical 80 mph to 100 mph offered by most site or stick built homes currently on the market.

Figure 5:
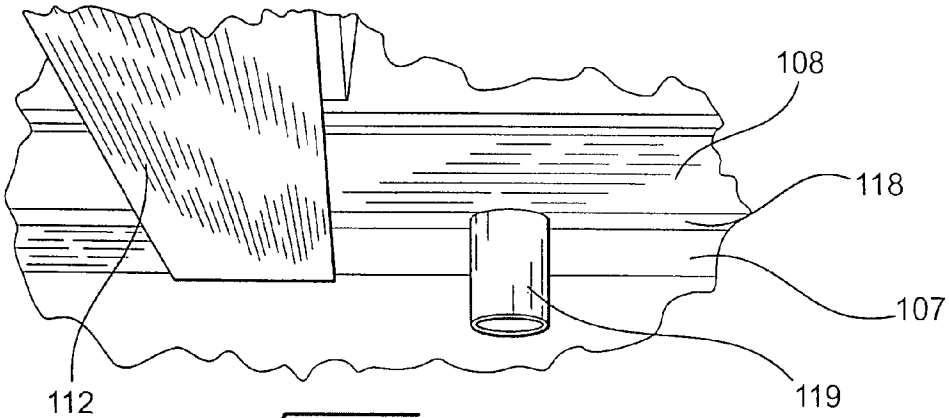
FIG. 5 is a side perspective view of the self-contained modular home of the present invention illustrating ventilation of the air space.

As described above, the foundation system of the present invention creates an air space 118 of approximately one and one half inch between the slab and the bottom of the 2"×8" floor joists. This air space can be vented with one or more foundation vents 119 as shown in FIG. 5. Preferably, the foundation vents are in the form of rectangular plastic ducts dimensioned 1½" in height by 6" in width. One or more 6" openings are cut into the treated sill 107 and a plastic vent 119 is inserted into each opening. These vents can be adjustable lengthwise depending on the exterior finish siding. For example, if the finish siding is a brick veneer, the vent can be pulled outward about four inches. If the siding is vinyl or hardi-pak, the vents are pulled outward to match the thickness. Optionally, the foundation vents can be omitted and the air space 117 can be conditioned with the modular homes HVAC system.

Figure 6:
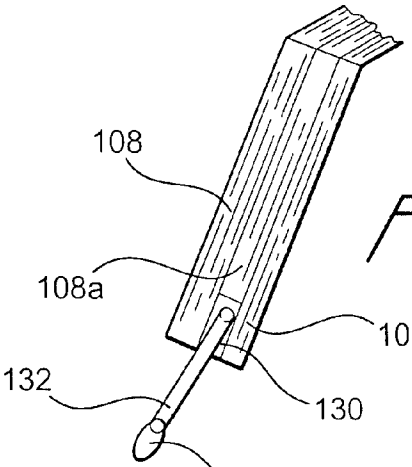
FIG. 6 is a side perspective view showing the floor system of the self-contained modular home of the present invention.

Typically, a modular home is set with a crane using either cables or straps that are placed around the side and bottom of each component module. The lifting system used to set the modular home onto the permanent foundation is novel to the present invention. More particularly, and referring to FIG. 6, the outside wall/floor joist system is constructed with a 2"×6" floor joist 108*a* sandwiched between the 2"×8" floor joist 108 and a second 2"×8" fleer joist 108*b*. This arrangement creates a channel 130 through which a steel cable 132 can be introduced. In one embodiment, the cables are pulled straight through and extend outside the end of each channel. Each end of the cable 132 is provided with a loop 134. An all terrain lift, such as a fork lift, is used at each end of the modular home to attach to the cables and carry the component module to the slab. In a second embodiment, the cables are incorporated into the outside floor system and pulled up through the walls and roof for attachment to a crane rigging. The cables can be left in the modular home so that, if it is desired, the home can be moved again.

The roof truss system of the self-contained modular home of present invention comprises a half truss with a separate roof cap attachment 180 as shown in FIG. 2. The half-truss (122 and 152) is designed in such a manner that all of the A/C duct work is in place, along with electrical wiring and insulation. The trusses in the center of the home are slanted towards the marriage line 140 in order that the plastic wrapping will not hold water during shipment, storage and transport. In the attic area of the half truss, the A/C duct work and electrical wiring is connected together at the marriage wall. Then, the roof cap 180 is lifted into place and set onto the half truss system and screwed or otherwise secured together at each matching truss with a standard attachment plate. The roof cap is fully complete with shingles except for two rows at the joint which then are secured to the joint to provide a weather tight home. The top section 180 includes a ridge vent 182.

Figure 7:
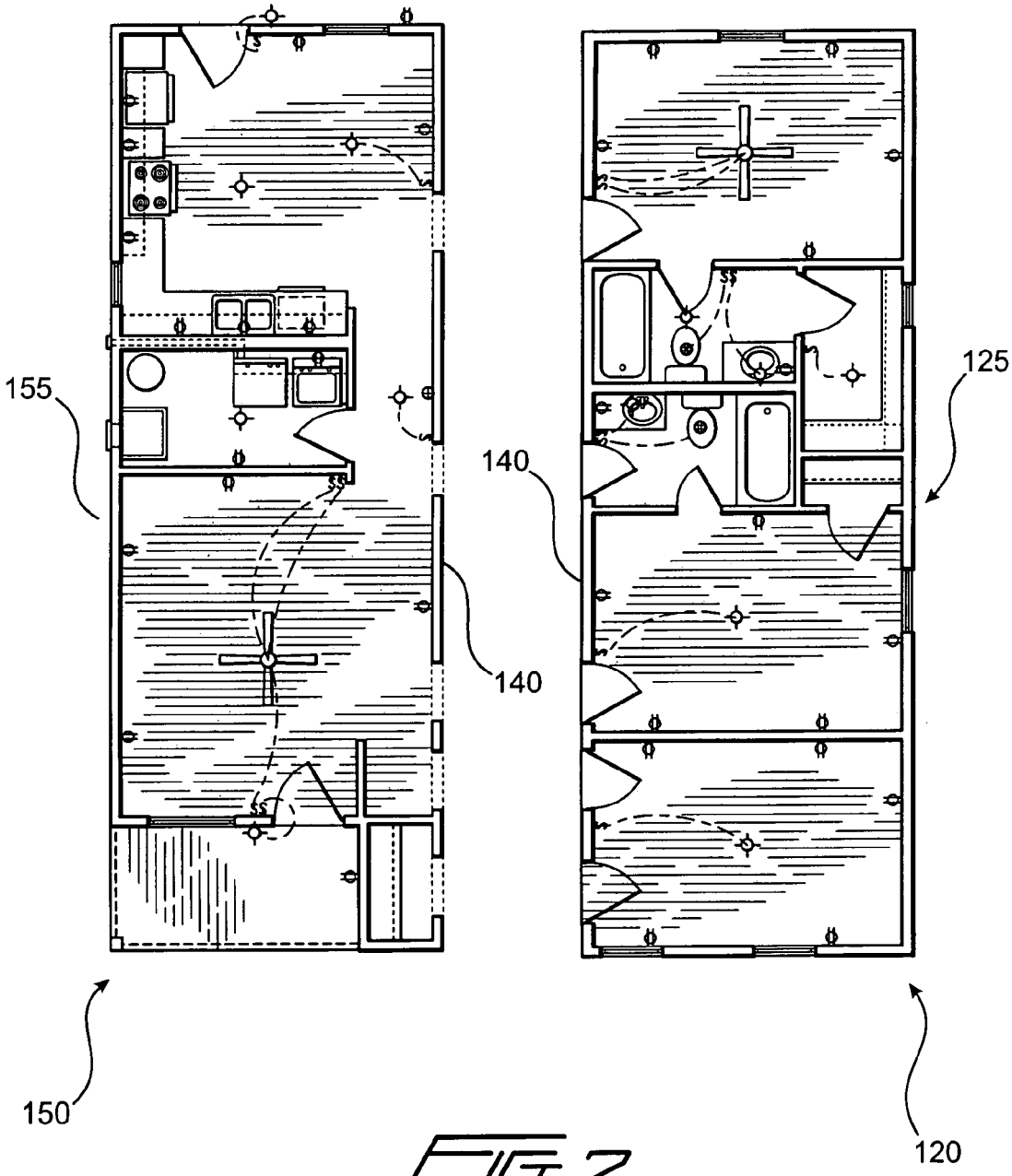
FIG. 7 is a side perspective view showing the interior of the first and second sections of the self-contained modular home of the present invention.
Figure 8:
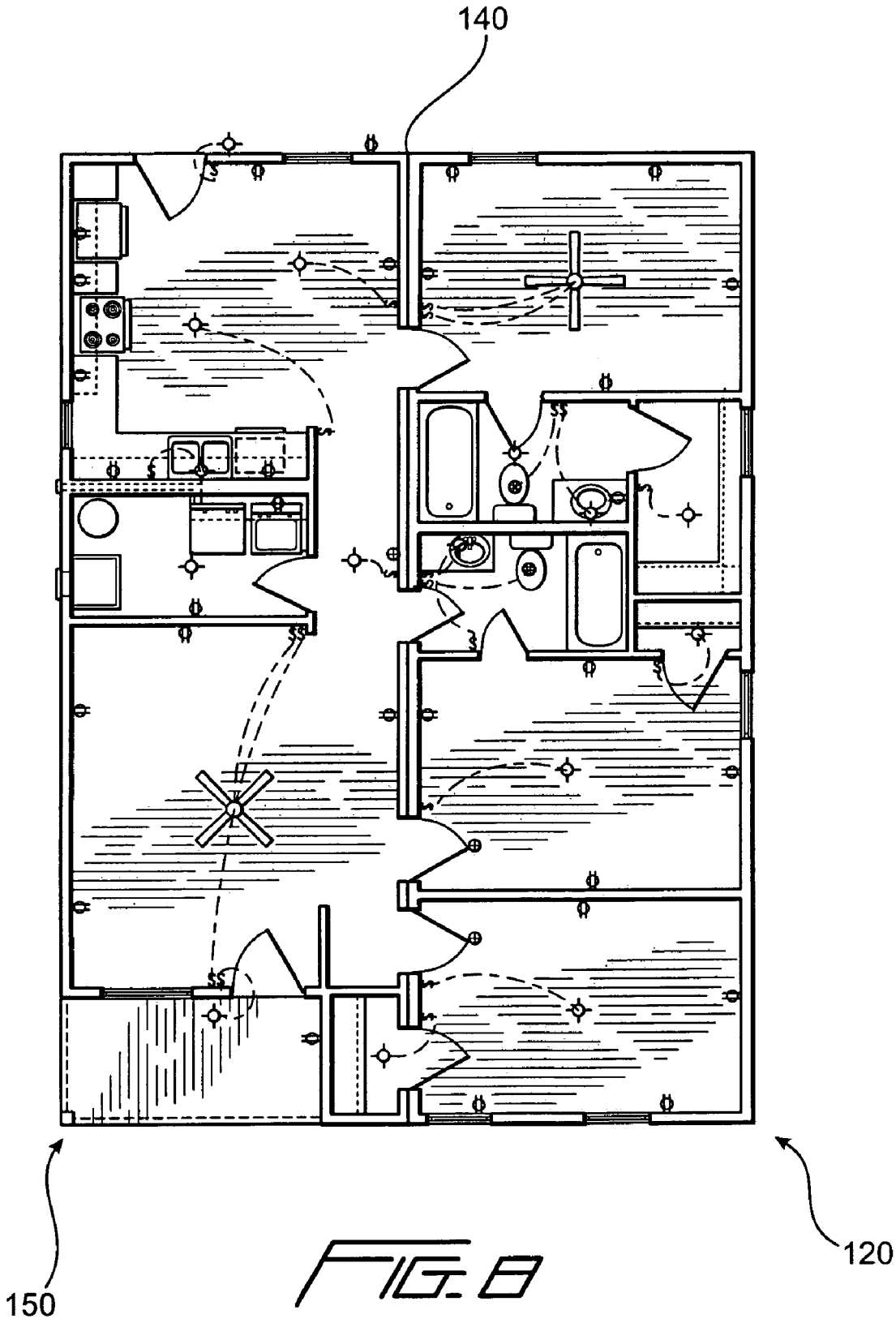
FIG. 8 is a top perspective view showing the marriage of the first and second sections of the self-contained modular home of the present invention.
Figure 9:
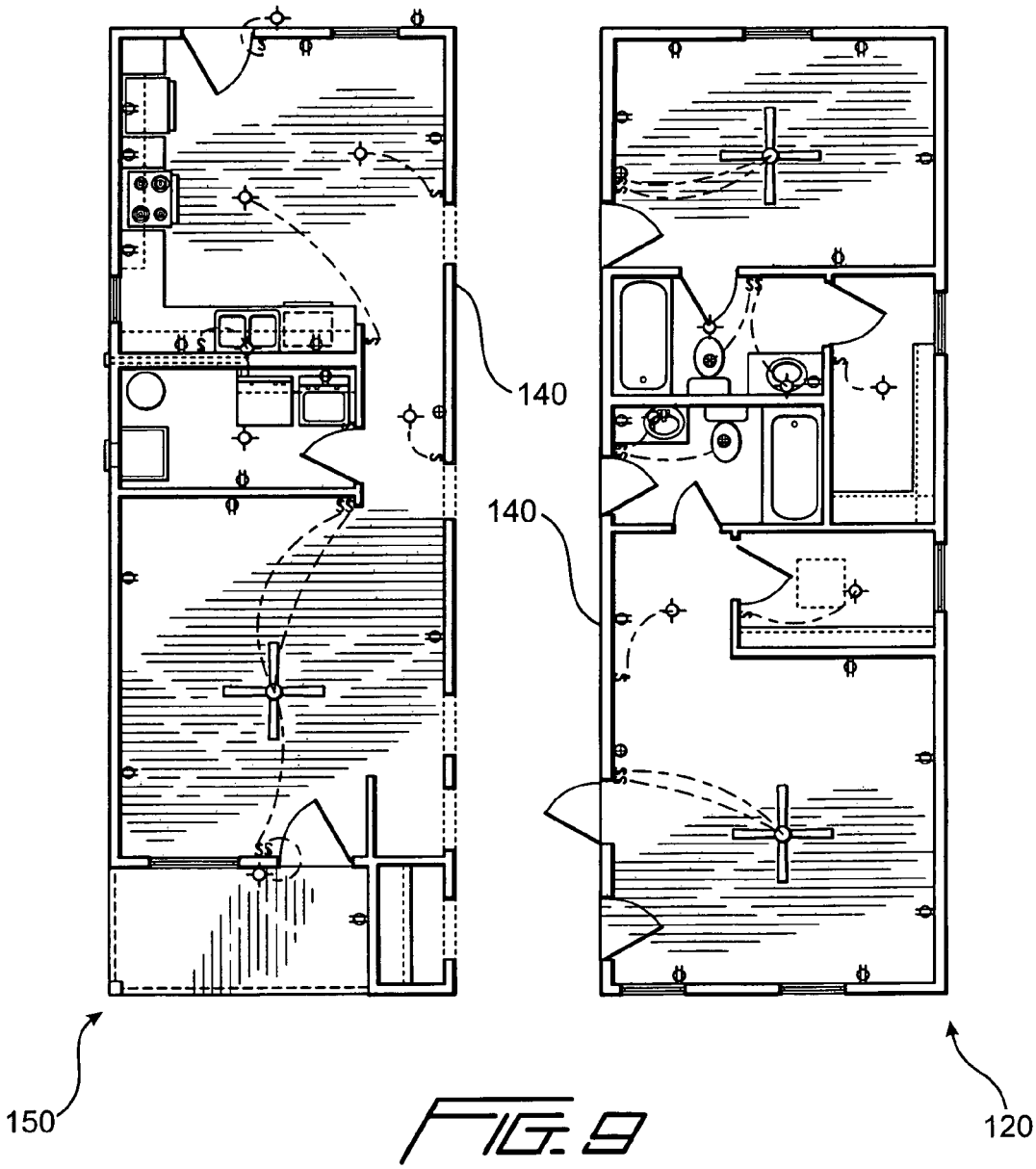
FIG. 9 is a top perspective view showing an alternative interior of the first and second sections of the self-contained modular home of the present invention.

Referring now to FIG. 7, the first section 120 is the bedroom section which is totally finished on the inside when it leaves the manufacturing plant. The finished bedroom section includes heat and air ducts, electrical system, plumbing works, eight foot sheetrock walls, flooring (such as carpet/vinyl) lighting and bathrooms with shower/bath, toilet, sink and cabinets. The floor plan shown in FIG. 6 includes three bedrooms. However, as shown in FIG. 8, an alternative floor plan having only two bedrooms also has been contemplated.

The second section 150 is the living section, comprising a family room, kitchen and dining area and utility room, the living section also is completely finished on the inside prior to leaving the factory. The finished living section includes a self-contained heat and air system including duct work, plumbing contained within the double utility wall and floor joist, eight foot sheetrock walls, flooring (e.g. carpet/vinyl), a complete kitchen including cabinets, sink, dishwasher, stove and refrigerator, and a front porch.

The plumbing system of the self-contained modular home also is novel to the present invention. All of the plumbing is 100% complete prior to leaving the factory. The plumbing system is built inside the 2"×8" floorjoist and travels with the home. The plumbing extends to outside walls 125 and 155 and then is turned downwardly toward the corresponding recessed area 103 cut out of the slab. In the first section 120, a three inch (3") pipe is used. The hot and cold water lines extend to the marriage wall 140 at the hall bath vanity. Under the hall bath vanity and on the opposite marriage wall is a removable access panel exposing a 15"×15" opening within which the hot and cold water lines can be connected together in about few minutes. In the second section 150, a two inch (2") pipe is used. A waste pipe is introduced from the street to the recessed area 103 disposed in the slab. Once the home is set on the slab, two elbow joints are used to connect the house plumbing to the waste pipe. This operation can be performed in about ten minutes.

The marriage wall 140 comprises five painted (finished) doors which are hung in place with the casing on one side (such as the second section side) and five painted (finished) door casings on the other side. Once the first section 120 and second section 150 are bolted to the slab, these five entries are completed simply by securing a pre-finished/painted 1"×6" trim board over the marriage wall joint. The trim board covers the joint and also acts as a door stop, rather than the ¾" door stop currently used.

The self-contained modular home also contains a whole-house fresh water cut offthat is place in line from the street to the house. The cut off valve is located in the utility room for easy access in the event of an emergency.

The self-contained modular home of the present invention is designed to be less than thirty two feet (32') wide. Thus, both the first section 120 and second section 150 are less than sixteen feet (16') wide. There are two reasons for designing a modular home of this width. First, each module can be transported on low boy trailers and meets the sixteen (16') maximum width for highway use. Second, most inner city lots are fifty foot (50') wide. Thus, a thirty two foot wide modular home of the present invention is suited perfectly for such a lot size, including side line setbacks.

In operation, once the modular home of the present invention arrives at the construction site, the home can be set and bolted to the concrete slab, made weather tight, connected to the local plumbing and electrical services and an be operational in about three hours.

Figure 10:
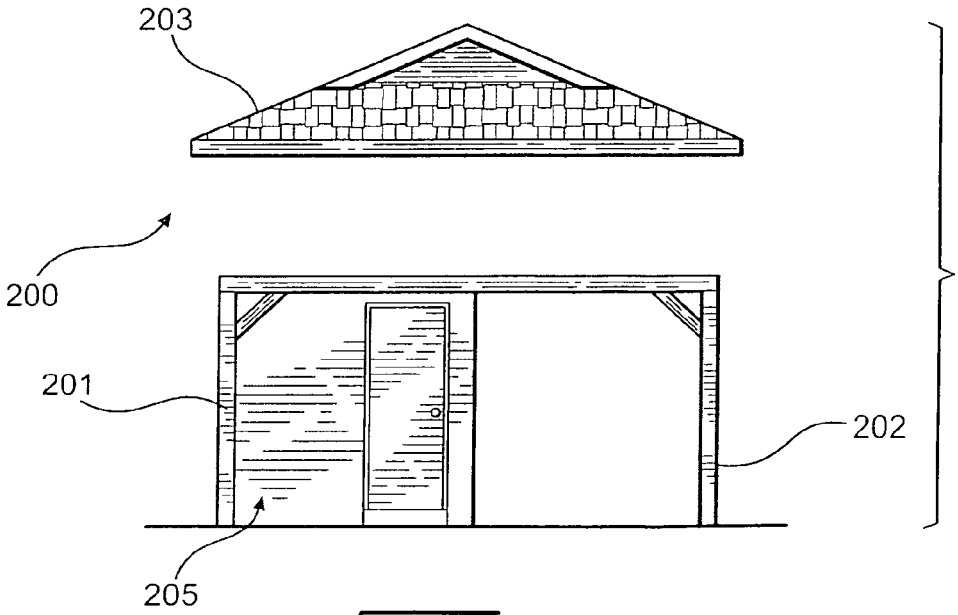
FIG. 10 is a side perspective view of the detached carport of the self-contained modular home of the present invention.

The self-contained modular home of the present invention also can include a car port 200. Referring now to FIG. 10, the car port comprises a frame structure 201 having four posts 202, a car port cap 203 which is shingled prior to leaving the factory and a storage shed 205. The three component modules are delivered to the construction site and the four posts 202 are set in concrete. The storage shed 205 secured to the frame structure and the car port cap 203 then is attached to the frame structure. Although the car port is shown as being detached, it will be obvious to those skilled in the art that the car port can be attached to the self-contained modular home of the present invention.

Figure 11A:
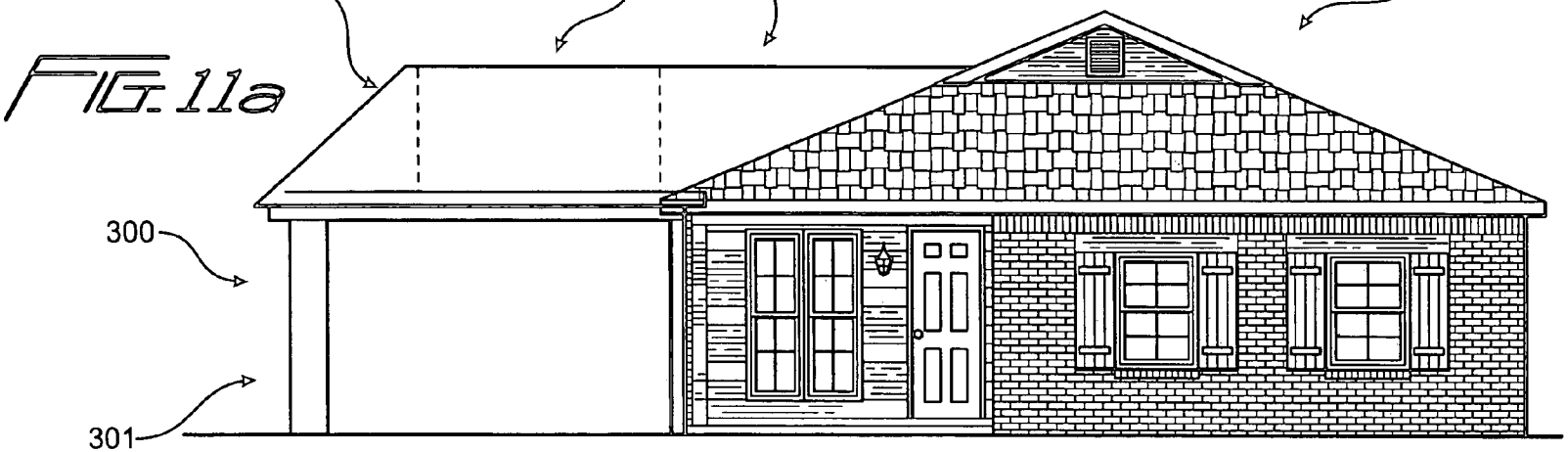
FIG. 11A is a side perspective view of the self-contained modular home of the present invention having a garage attached thereto.
Figure 11C:
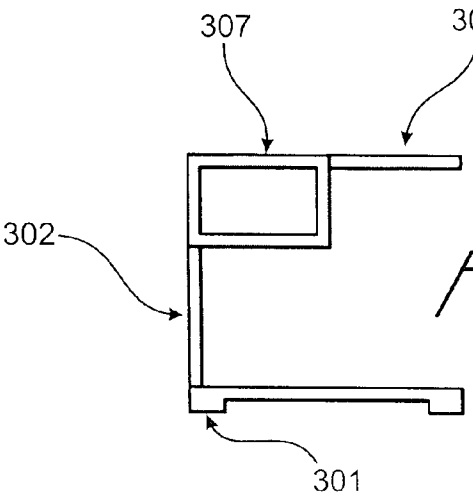
FIG. 11C is a top view of the self-contained modular home of the present invention having a garage attached thereto.
Figure 11B:
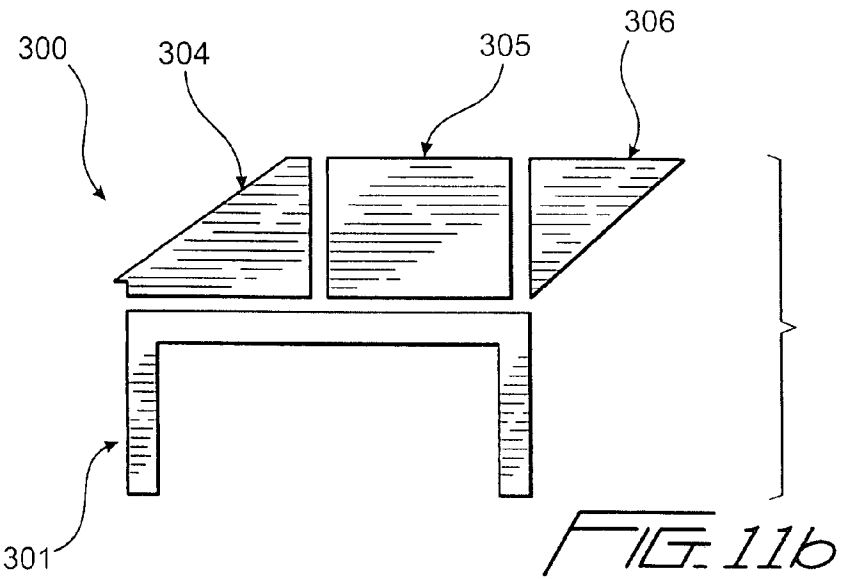
FIG. 11B is an exploded side view of the self-contained modular home of the present invention having a garage attached thereto.

The self-contained modular home of the present invention also can include an attached garage 300. Referring now to FIGS. 11A, 11B and 11C, the attached garage comprises seven component modules, including a front panel 301 having a double 2"×12" header opening and OSB on the outside, a side panel 302 having OSB on the outside, a rear panel 303 having OSB on the outside, a hip roof section 304 which is shingled, a middle roof section 305 which is shingled, an attachment roof section 306 which is shingled and a storage room 307 having OSB on the side and rear. In operation, once the self-contained modular home 100 is set and secured to the permanent foundation, the front panel 301 and rear panel 303 are attached to the modular home. Storage room 307 and side panel 302 then are attached to the rear panel and front panel respectively and to each other. The three roof sections then are secured to the garage and attachment roof section 306 also is secured to the modular home. Optionally, a door can be provided in the modular home, preferably near the utility room, to provide access to the garage from the modular home.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A self-contained modular home comprising;

a. a first section having exterior walls covered with house wrap, a first half truss pitched roof section which is shingled, a first foundation system and a first marriage wall, b. a second section having exterior walls covered with house wrap, a second half truss pitched roof section which is shingled, a second foundation system, and a second marriage wall corresponding to said first marriage wall, and c. a top section which is shingled and has a ridge vent, wherein said first section and said second section are set on and secured to a permanent foundation such that the first marriage wall is joined to the corresponding second marriage wall and said top section is secured to said first section and said second section, wherein, said permanent foundation comprises a right section corresponding to said first section, a left section corresponding to said second section, a perimeter, a treated sill bolted to said perimeter, and a plurality of structural bolts, each of said plurality of structural bolts having a first end embedded in said permanent foundation and a second end extending outwardly and horizontally from said perimeter of said foundation, and wherein, said permanent foundation being constructed in such a manner that a recessed area is created along the perimeter in each of said right section and said left section to enable plumbing to drop out of said first section and said second section and be connected to a sewer outfall.

2. The self-contained modular home in accordance with claim 1, wherein said permanent foundation is in the form of a concrete slab.

3. The self-contained modular home in accordance with claim 2, wherein said first and second foundation systems comprise a floor joist system, a wood floor and a bottom plate, wherein when said first section and said second section are set onto said permanent foundation, said floor joist system contacts said treated sill.

4. The self-contained modular home in accordance with claim 3, wherein said first and second sections are secured to said permanent foundation with an arrangement of a plurality of steel plates and lag screws.

5. The self-contained modular home in accordance with claim 3, wherein said first and second sections are secured to said permanent foundation with an arrangement of a plurality of steel plates corresponding in number to said plurality of structural bolts, wherein one of said plurality of steel plates first is attached to said second end of one of said plurality of structural bolts and wherein each of said plurality of steel plates then is secured into said floor joist and into an attachment stud by means of lag screws.

6. The self-contained modular home in accordance with claim 3, wherein said bottom steel plate is secured two foot on center to said treated sill and said floor joist system.

7. The self-contained modular home in accordance with claim 3, wherein when said first and second foundation systems are secured to said permanent foundation, an air space of about one and half inch is created between said permanent foundation and said self-contained modular home, further comprising at least one foundation vent which is disposed in an opening in said treated sill.

8. The self-contained modular home in accordance with claim 3, wherein said floor joist system is constructed from a 2"×6" treated material sandwiched between a first 2"×8" treated material and a second 2"×8" treated material in such a manner that a channel is established between said first and second 2"×8" treated materials, and wherein a steel cable having first and second looped ends is introduced into extends through said channel.

9. The self-contained modular home in accordance with claim 8, wherein each of said first section and said second section can be lifted, carried and set onto said permanent foundation by attaching and securing each of said looped ends of said cable to an all terrain lift vehicle.

10. The self-contained modular home in accordance with claim 8, wherein said steel cable are extending upwardly through said first and second sections for attachment to a crane rigging such that said first section and said second section can be lifted, carried and set onto said permanent foundation by said crane rigging.

11. The self contained modular home in accordance with claim 1, wherein trusses in each of said first half-truss pitched roof section and said second half-truss pitched roof section are slanted towards said marriage wall such that the top section can be secured to the first and second sections at each matching truss.

12. The self-contained modular home in accordance with claim 2, further comprising a complete plumbing system that is built within said floor joist system and having at least one plumbing conduit in each of said first section and said second section which extends outwardly to said exterior and downwardly toward said recessed area which can be connected to a waste pipe disposed in said recessed area.

13. The self-contained modular home in accordance with claim 1, wherein said first section comprises at least one bedroom, at least one bathroom having a shower/bath, toilet and sink, HVAC duct work, an electrical system, plumbing works, finished eight foot sheetrock walls, finished flooring and lightening.

14. The self-contained modular home in accordance with claim 1, wherein said second section comprises a family room, a dining area, a kitchen having cabinets, a refrigerator, dishwasher and stove, self-contained HVAC system including duct work, plumbing works, an electrical system, a utility room and a front porch.

15. The self-contained modular home in accordance with claim 1, wherein said first marriage wall comprises five finished doors which are hung in place with half-casing and said second marriage wall comprises five finished half-casings corresponding to said five finished doors, and wherein once said first and second sections are secured to said permanent foundation, said five finished doors with half casing are joined to said five finished half-casings to form five entries and are completed by attaching a pre-finished trim board over each of said five entries.

16. The self-contained modular home in accordance with claim 1, further comprising a whole-house fresh water cut off valve.

17. The self-contained modular home in accordance with claim 1, wherein each of said first section and said second section less than sixteen feet (16') wide.

18. The self-contained modular home in accordance with claim 1, further comprising a car port.

19. The self-contained modular home in accordance with claim 1, further comprising a garage attached to said modular home.

20. The self-contained modular home in accordance with claim 19, wherein said garage is assembled from a plurality of component modules.

* * * * *